United States Patent [19]

Forbes, II

[11] Patent Number: 4,641,946

[45] Date of Patent: Feb. 10, 1987

[54] DEVELOPMENT SYSTEM

[75] Inventor: Richard L. Forbes, II, Pittford, N.Y.

[73] Assignee: Xerox Corporation, Stamford, Conn.

[21] Appl. No.: 759,992

[22] Filed: Jul. 29, 1985

[51] Int. Cl.[4] ..... G03G 15/09

[52] U.S. Cl. ..... 355/3 DD; 118/658

[58] Field of Search ..... 355/3 DD, 3 R; 118/657, 118/658, 656; 430/122

[56] References Cited

U.S. PATENT DOCUMENTS

| | | | |
|---|---|---|---|
| 4,013,041 | 3/1977 | Armstrong et al. | 118/656 |
| 4,368,970 | 1/1983 | Hays | 355/3 DD |
| 4,397,264 | 8/1983 | Hatch | 118/656 |
| 4,537,494 | 8/1985 | Lubinsky et al. | 355/3 DD |
| 4,565,437 | 1/1986 | Lubinsky | 355/3 DD |

*Primary Examiner*—R. L. Moses

*Attorney, Agent, or Firm*—H. Fleischer; J. E. Beck; R. Zibelli

[57] ABSTRACT

An apparatus which develops a latent image recorded on a flexible member with developer material comprising at least magnetic granules and toner particles. Developer material is transported closely adjacent to a flexible member having the latent image recorded thereon. A radial magnetic field is generated in the development zone to optimize the attraction of the toner particles from the carrier granules to the latent image. A tangential magnetic field is generated at the exit of the development zone to prevent carrier granules from adhering to the flexible member. The magnitude of the tangential magnetic field at the exit of the development zone is greater than the magnitude of the radial magnetic field at the center of the development zone.

10 Claims, 4 Drawing Figures

DEVELOPMENT SYSTEM

This invention relates generally to an electrophotographic printing machine, and more particularly concerns an apparatus for developing a latent image.

In general, electrophotographic printing requires a photoconductive member which is charged to a substantially uniform potential to sensitize the surface thereof. The charged portion of the photoconductive surface is exposed to a light image of an original document being reproduced. This records an electrostatic latent image on the photoconductive surface which corresponds to the informational areas contained within the original document. After the electrostatic latent image is recorded on the photoconductive surface, it is developed by bringing a developer material into contact therewith. This forms a powder image on the photoconductive surface which is subsequently transferred to a copy sheet. Finally, the copy sheet is heated to permanently affix the powder image thereto in image configuration.

Frequently, the developer material is made from a mixture of magnetic carrier granules and toner particles with the toner particles adhering triboelectrically to the carrier granules. This two-component mixture is brought into contact with the latent image. Toner particles are attracted from the carrier granules to the latent image forming a powder image thereof. Most electrophotographic printing machines employ a magnetic brush development system for developing the latent image. The magnetic brush development system may use one or more developer rollers for transporting the developer material closely adjacent to the photoconductive surface. With the increased use of flexible photoconductive belts, it has become more feasible to control the spacing between the belt and developer roller. When the photoconductive belt is maintained under the proper tension, it now becomes practical to permit the developer material to space the photoconductive belt from the developer roller. In this type of a system, it is desirable to generate a relatively weak magnetic field in the development zone to promote agitation of the developer material. This improves development of the latent image recorded on the photoconductive belt. However, it has been found that carrier granules tend to adhere to the photoconductive belt degradating the quality of the copy. Thus, it is necessary to improve the development system by eliminating any residual carrier granules from adhering to the photoconductive belt after development has been completed. Hereinbefore, various techniques have been employed to remove carrier granules adhering to the photoconductive belt. For example, a pickoff magnet may be positioned after the developer roller to remove any residual carrier granules adhering to the photoconductive belt after development. However, a system of this type results in increased cost and complexity. Thus, it would be desirable to be capable of preventing the adherence of carrier granules to the photoconductive belt during development, while still optimizing development, without the necessity of employing additional components in the system.

Various approaches have been devised to improve development. The following disclosures appear to be relevant:

U.S. Pat. No. 4,013,041; Patentee: Armstrong et al.; Issued: Mar. 22, 1977.

Research Disclosure Journal, July 1979, Page 352, No. 18318; Disclosed by: Swapceinski.

U.S. Pat. No. 4,368,970; Patentee: Hays; Issued: Jan. 18, 1983.

U.S. Pat. No. 4,397,264; Patentee: Hatch; Issued: Aug. 9, 1983.

The pertinent portions of the foregoing disclosures may be briefly summarized as follows:

Armstrong et al. describes an electrophotographic printing machine having a magnetic brush developer roller contacting one side of a flexible photoconductive belt. Guide rollers maintain a portion of the belt in a slackened condition so that the belt is capable of moving freely toward and away from the developer roller in response to the varying contours thereof.

Swapceinski describes an electrophotographic printing machine having a gimbled backup roller engaging the backside of a photoconductive belt. The guide roller opposed from the developer roller compensates for relative changes in the thickness of the developer material on the developer roll, as well as maintaining a constant pressure in the nip between the developer roll and photoconductive belt.

Hays discloses a development system wherein a photoconductive belt is wrapped about the developer roller to form an extended development zone. The magnetic field in the development zone is low to obtain maximum agitation of the developer material.

Hatch describes an electrophotographic printing machine in which developer material on the developer roller deflects a tensioned photoconductive belt so as to wrap about a portion of the developer roller.

In accordance with one aspect of the features of the present invention, there is provided an apparatus for developing a latent image recorded on a flexible member. Magnetic means are positioned closely adjacent to the flexible member to define a development zone therebetween for transporting a developer material comprising at least magnetic carrier granules and toner particles into contact with the flexible member in the development zone. A radial magnetic field is generated in the development zone of a magnitude to optimize the attraction of the toner particles from the carrier granules to the latent image. A tangential magnetic field is generated at the exit of the development zone of a magnitude to optimize the adherence of the carrier granules to the magnetic means so as to prevent carrier granules from adhering to the flexible member. The magnitude of the tangential magnetic field at the exit of the development zone is greater than the magnitude of the radial magnetic field in the center of the development zone. Means maintain the flexible member at a preselected tension of sufficient magnitude so that the developer material being transported into contact therewith deflects the flexible member about the magnetic means to form an extended development zone.

Pursuant to another aspect of the present invention, there is provided an electrophotographic printing machine of the type having an electrostatic latent image recorded on a flexible photoconductive member. The printing machine includes magnetic means positioned closely adjacent to the flexible photoconductive member to define a development zone therebetween for transporting a developer material comprising at least magnetic carrier granules and toner particles into contact with the flexible photoconductive member in the development zone. A radial magnetic field is generated in the development zone of a magnitude to optimize the attraction of the toner particles from the carrier granules to the latent image. A tangential magnetic field is generated at the exit of the development zone of a magnitude to optimize the adherence of the carrier granules to the magnetic means so as to prevent carrier granules from adhering to the flexible photoconductive member. The magnitude of the tangential magnetic field at the exit of the development field is greater than the magnitude of the radial magnetic field in the center of the development zone. Means maintain the flexible photoconductive member at a preselected tension of sufficient magnitude so that the developer material being transported into contact therewith deflects the flexible photoconductive member about the magnetic means to form an extended development zone.

Other aspects of the present invention will become apparent as the following discription proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents that may be included within the spirit and scope of the invention as defined by the appended claims.

Figure 1:
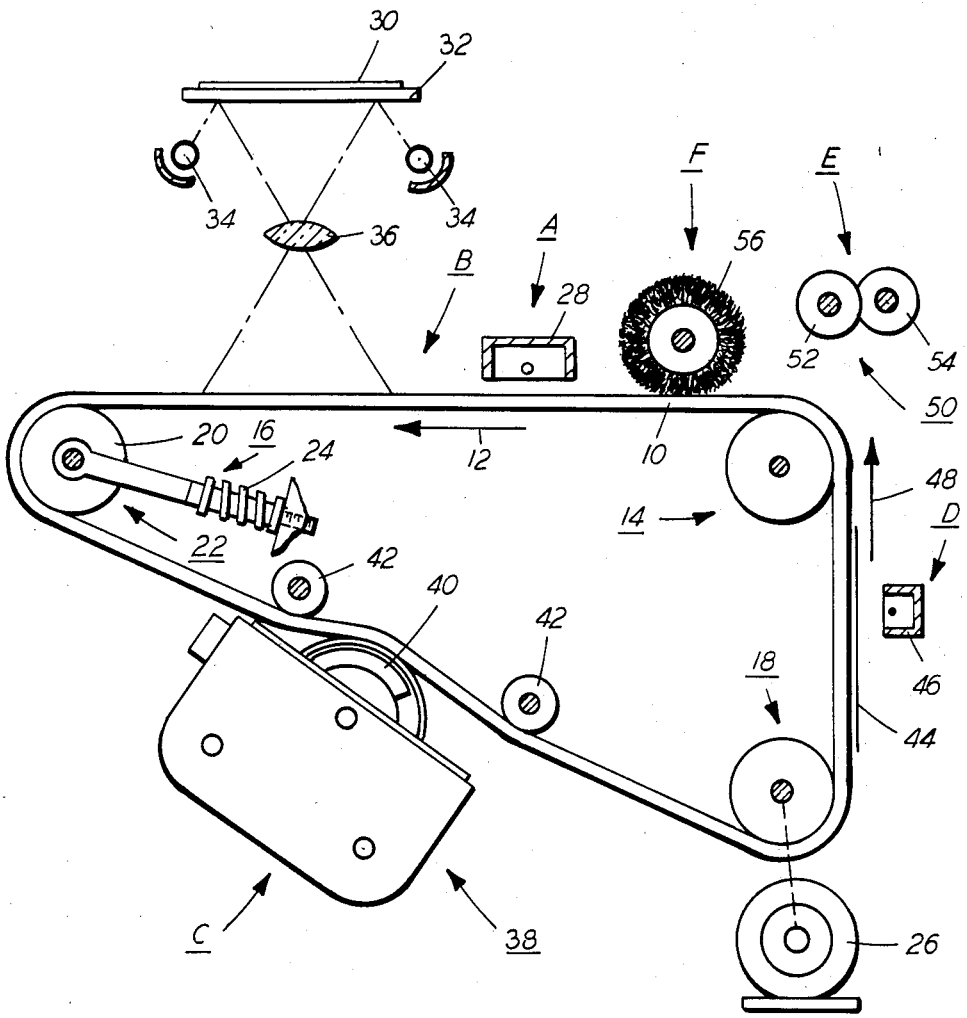
FIG. 1 is a schematic elevational view depicting an electrophotographic printing machine incorporating the features of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of the illustrative electrophotographic printing machine employing the development system of the present invention therein. Although this development system is particularly well adapted for use in electrophotographic printing, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. Preferably, the photoconductive surface is made from a selenium alloy with the conductive substrate being made from aluminum which is electrically grounded. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16, and drive roller 18. As shown in FIG. 1, tensioning system 16 includes a roller 20 over which belt 10 moves. Roller 20 is mounted rotatably in yoke 22. Spring 24, which is initially compressed, resilently urges yoke 22 in a direction such that roller 20 presses against belt 10. The level of tension is relatively low permitting belt 10 to be easily deflected. The detailed structure of the tensioning system will be described hereinafter with reference to FIG. 2.

With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means, such as a belt drive. Stripping roller 14 is freely rotatable so as to permit belt 10 to move in the direction of arrow 12 with a miniumum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned face down upon transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30. Although an optical system has been described forming a light image of the information contained in an original document, one skilled in the art will appreciate that a modulated beam of energy, e.g. a laser beam, may be employed to irradiate the charged portion of the photoconductive surface to form an electrostatic latent image thereon. Modulation of the laser beam is achieved by processing signals corresponding to the information desired to be reproduced and, in turn, controlling the laser beam modulation in accordance therewith.

After the electrostatic latent image has been recorded on the photoconductive surface of belt 10, the latent image advances to development station C. At development station C, a magnetic brush development system, indicated generally by the reference numeral 38, advances developer material into contact with the electrostatic latent image. Preferably, magnetic brush development system 38 includes a developer roller 40. Developer roller 40 transports a brush of developer material comprising magnetic carrier granules and toner particles into contact with belt 10. As shown in FIG. 1, developer roller 40 is positioned such that the brush of developer material deflects belt 10 between idler rollers 42 in an arc with belt 10 conforming, at least partially, to the configuration of the developer material and wrapping around developer roller 40 to form an extended development zone. The electrostatic latent image attracts the toner particles from the carrier granules forming a toner powder image of the photoconductive surface of belt 10. The detailed structure of magnetic brush development system 38 will be described hereinafter with reference to FIG. 3.

After development, belt 10 advances the toner powder image to transfer station D. At transfer station D, a sheet of support material 44 is moved into contact with the toner powder image. Sheet of support material 44 is advanced to transfer station D by a sheet feeding apparatus (not shown). By way of example, the sheet feeding apparatus may include a feed roll contacting the uppermost sheet of a stack of sheets. The feed roll rotates to advance the uppermost sheet from the stack into a chute. The chute directs the advancing sheet of support material into contact with the photoconductive surface of belt 10 in a timed sequence so that the toner powder image developed thereon contacts the advancing sheet of support material at transfer station D.

Transfer station D includes a corona generating device 46 which sprays ions onto the backside of sheet 44. This attracts the toner powder image from the photoconductive surface to sheet 44. After transfer, sheet 44 moves in the direction of arrow 48 onto a conveyor (not shown) which advances sheet 44 to fusing station E.

Fusing station E includes a fuser assembly, indicated generally by the reference numeral 50, which permanently affixes the toner powder image to sheet 44. Preferably, fuser assembly 50 includes a heated fuser roller 52 and a back-up roller 54. Sheet 44 passes between fuser roller 52 and back-up roller 54 with the toner powder image contacting fuser roller 52. In this manner, the toner powder image is permanently affixed to sheet 44. After fusing, a chute guides sheet 44 to a catch tray for subsequent removal from the printing machine by the operator.

Invariably, after the sheet of support material is separated from the photoconductive surface of belt 10, some residual particles remain adhering thereto. These residual particles are removed from the photoconductive surface at cleaning station F. Cleaning station F includes a rotatably mounted fiberous brush 56 in contact with the photoconductive surface. Particles are cleaned from the photoconductive surface by the rotation of brush 56. Subsequent to cleaning, a discharge lamp, (not shown) floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an illustrative electrophotographic printing machine incorporating the features of the present invention therein.

Figure 2:
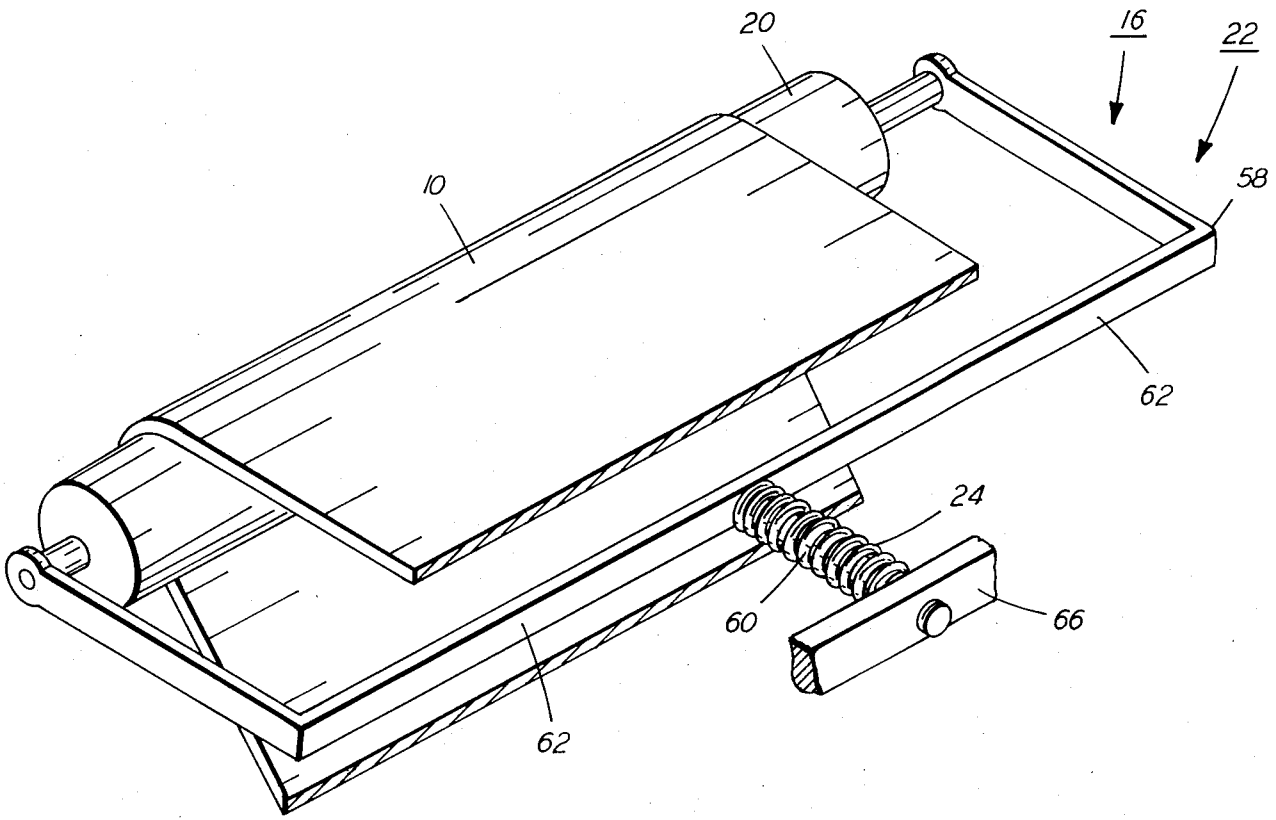
FIG. 2 is a fragmentary, perspective view showing the belt tensioning arrangement for the FIG. 1 printing machine.

Referring now to the specific subject matter of the present invention, FIG. 2 depicts tensioning system 16 in greater detail. As shown thereat, tensioning system 16 includes roller 20 having belt 10 passing thereover. Roller 20 is mounted in suitable bearings in a yoke, indicated generally by the reference numeral 22. Preferably, yoke 22 includes a U-shaped member 58 supporting roller 20 and a rod 60 secured to the midpoint of cross member 62 of U-shaped member 58. Coil spring 24 is wrapped around rod 60. Rod 60 is mounted slidably in the printing machine frame 66. Spring 24 is compressed between cross member 62 and frame 66. Compressed spring 24 resilently urges yoke 22 and, in turn, roller 20 against belt 10. Spring 24 is designed to have the appropriate spring constant such that when placed under the desired compression, belt 10 is tensioned from about 0.1 to about 0.15 kilograms per linear centimeter. Belt 10 is maintained under a suffiently low tension to enable the developer material on developer roller 40 to deflect belt 10 through an extended development zone corresponding to an arc ranging from about 10 degrees to about 40 degrees.

Figure 3:
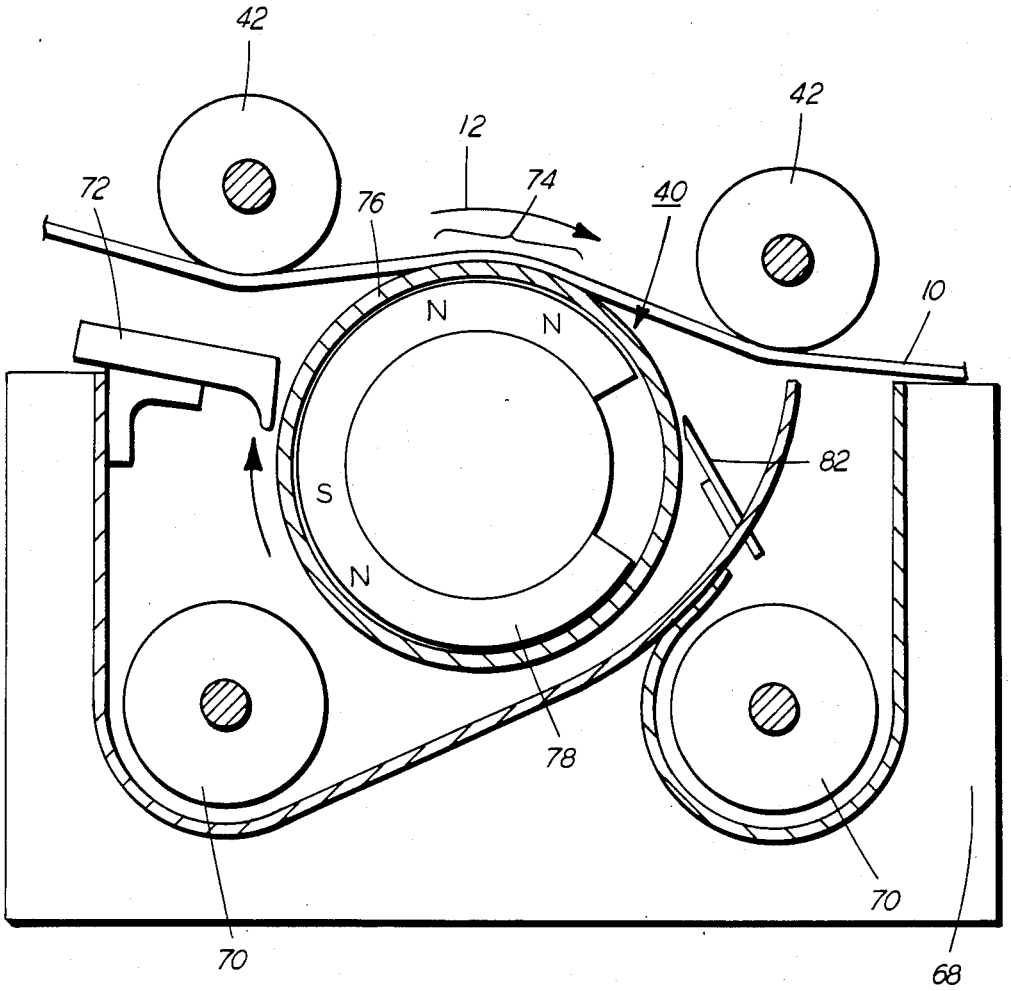
FIG. 3 is an elevational view illustrating the development system used in the FIG. 1 printing machine.

Turning now to FIG. 3, the detailed structure of development system 38 will be described. Development system 38 includes a housing 68 defining a chamber for storing a supply of developer material therein. The developer material includes magnetic carrier granules having toner particles adhering triboelectrically thereto. In this way, during the development process, the toner particles are attracted from the carrier granules to the latent image forming a toner powder image thereon. A pair of augers 70 mix the developer material in the chamber of housing 68 and advance the developer material to developer roller 40. Developer roller 40 advances the developer material into contact with the electrostatic latent image recorded on the photoconductive surface of belt 10. A trim bar 72 regulates the thickness of the developer pile height on developer roller 40. The tangential velocity of developer roller 40 is in the same direction and at about 2 to 3 times the magnitude of the velocity of belt 10. The compressed pile height of the developer material ranges from about 0.05 centimeters to about 0.15 centimeters. Trim bar 72 extends in a longitudinal direction substantially across the width of developer roller 40 so as to provide a uniform gap therebetween controlling the quantity of developer material being moved into development zone 74. Developer roller 40 includes a non-magnetic tubular member 76, preferably made from a aluminum having the exterior circumferential surface thereof roughened. Elongated magnet 78 is positioned concentrically within tubular member 76 and mounted on shaft 80. Magnet 78 has magnetic poles impressed about the circumferential surface thereof. The intensity of the magnetic field generated by magnet 78 is such as to provide a magnetic field in development zone 74 which promotes agitation of the developer material so as to optimize development of the electrostatic latent image. Preferably, the radial magnetic field on the surface of tubular member 76 in development zone 74 ranges from about 0 gauss to about 500 gauss. The radial magnetic field on the surface of tubular member 76 at the center of development zone 74 ranges preferably from about 0 gauss to about 400 gauss. The tangential magnetic field at the exit to development zone 74 is preferably of a magnitude sufficient to attract the carrier granules to tubular member 76 of developer roller 40. This prevents carrier granules from adhering to the photoconductive surface of belt 10 degradating the resultant copy quality. The developer material being transported into development zone 74 becomes highly agitated due to the shearing action between the brush of developer material and the photoconductive surface. At the exit to the development zone, a high tangential magnetic field causes the carrier granules to remain adhering to tubular member 76 rather than to the photoconductive surface of belt 10. The tangential magnetic field on the surface of tubular member 76 at the exit of development zone 74 ranges from about 300 gauss to about 550 gauss. Blade 82 assists in scraping the developer material from tubular member 76. Preferably, tubular member 76 is electrically biased by a voltage source (not shown) to a suitable polarity and magnitude. The voltage level is intermediate that of the background voltage and the image voltage levels recorded on the photoconductive surface of belt 10. By way of example, the voltage source electrically biases tubular member 76 to a voltage ranging from about 0 volts to about 100 volts relative to the background voltage on the photoconductive surface. As tubular member 76 rotates at a constant angular velocity, a brush of developer material is formed on the perpherial surface thereof. The brush of developer material advances into contact with belt 10 in development zone 74. As previously mentioned, the brush of developer material in development zone 74 deflects belt 10 to wrap about developer roller 40 to form an extended development zone. Magnetic member 78 is mounted stationarily to attract the developer material to tubular member 76 due to the magnetic properties of the carrier granules. In development zone 74, the toner particles are attracted from the magnetic carrier granules to the latent image forming a toner powder image on the photoconductive surface of belt 10.

Figure 4:
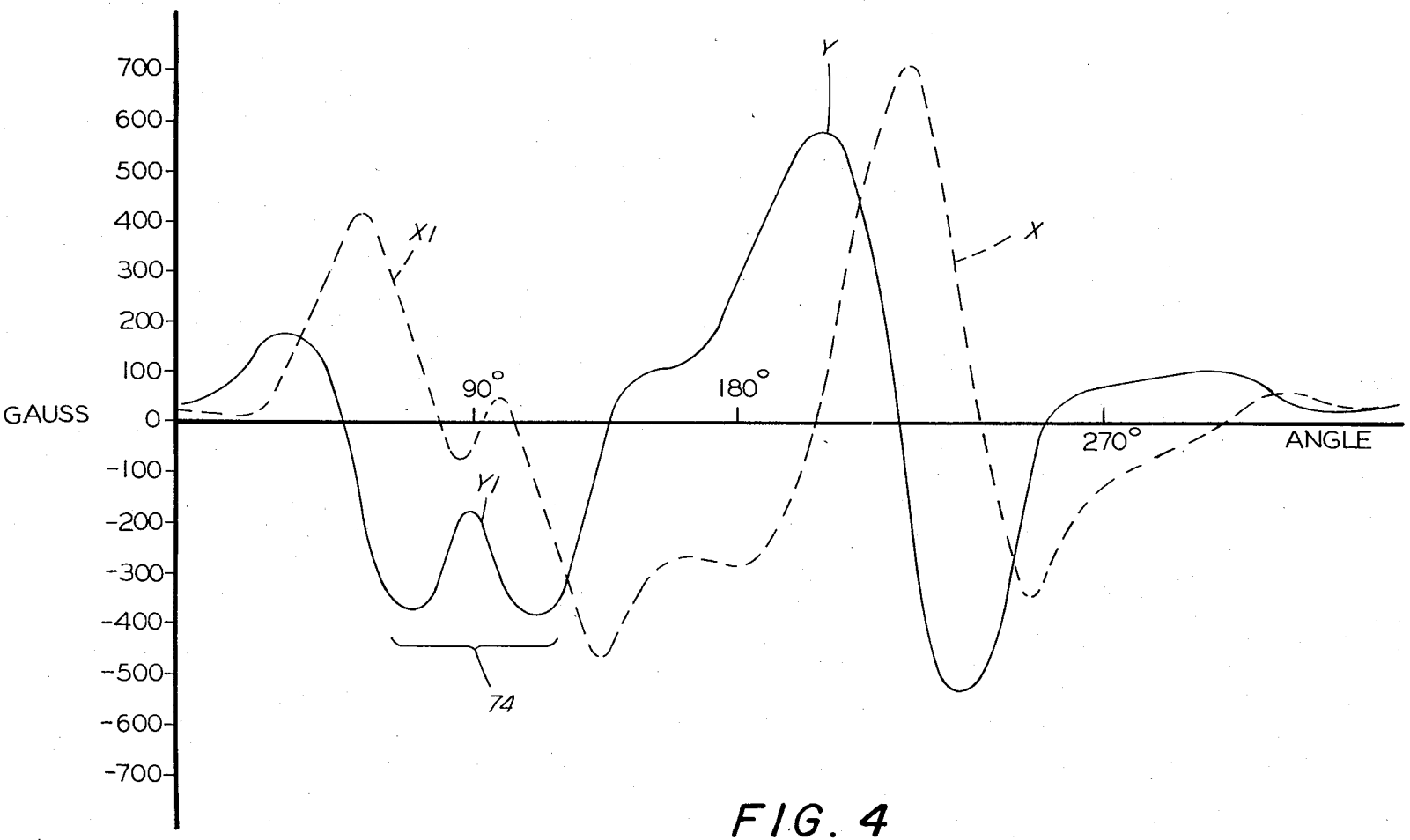
FIG. 4 is an exemplary graph showing the radial and tangential magnetic fields generated by the developer roller of the FIG. 3 development system.

Turning now to FIG. 4, there is shown an exemplary graph depicting the intensity of the magnetic field about the circumference of developer roller 40. As shown in FIG. 4, graph X (shown by dashed lines) represents the intensity of the tangential magnetic field being generated at the surface of tubular member 76 about developer roller 40 by magnet 78. Graph Y (shown by solid lines) represents the intensity of the radial magnetic field at the surface of tubular member 76 as generated by magnet 78. Point X1 corresponds to the intensity of the tangential magnetic field at the exit to the development zone. Point Y1 corresponds to the intensity of the radial magnetic field at the center of development zone 74. As shown, the intensity of the tangential magnetic field at the exit to the development zone is about 350 gauss. The intensity of the radial magnetic field at the center of the development zone 74 is about 200 gauss.

One skilled in the art will appreciate that other suitable radial and tangential magnetic field strengths having graphs differing from that of FIG. 4 may also be employed. For example, the radial magnetic field strength at the center of the development zone may be about 385 gauss with the tangential magnetic field strength at the exit of the development zone being 480 gauss; or the radial magnetic field strength at the center of the development zone may be about 0 gauss with the tangential magnetic field strength at the exit of the development zone being about 485 gauss; or the radial magnetic field strength at the center of the development zone may be about 0 gauss with the tangential magnetic field strength at the exit of the development zone being about 505 gauss.

It is clear that the tangential magnetic field at the exit to the development zone is greater than the radial magnetic field at the center of the development zone. The magnetic field intensity profile results in a high tangential magnetic field at the exit of the development zone with a low magnetic field in the development zone. This improves development of the electrostatic latent image while preventing carrier granules from being carried out of the development zone on the photoconductive zone of belt 10. By the utilization of a high tangential magnetic field, the carrier granules are always under control, i.e. they are not spraying out of the development zone and becoming airborne as developer material passes through the radial magnetic field development pole into the tangential magnetic field transport region.

It is, therefore, evident that there has been provided in accordance with the present invention an apparatus for developing an electrostatic latent image that significantly improves developability while preventing the escape of carrier granules from the developer housing. This apparatus fully satisfies the advantages hereinbefore set forth. While this invention has been described in conjunction with a specific embodiment, it is evident that many alternatives, modifications and variations will be apparent to those skilled in the art. Accordingly, it is intended to embrace all such alternatives, modifications and variations that fall within the spirit and broad scope of the appended claims.

I claim:

1. An apparatus for developing a latent image recorded on a flexible member, including:

magnetic means, positioned closely adjacent the flexible member to define a development zone therebetween, for transporting a developer material comprising at least magnetic carrier granules having toner particles adhering thereto into contact with the flexible member in the development zone, said magnetic member generating at least a radial magnetic field in the development zone of a magnitude to optimize the attraction of the toner particles from the carrier granules to the latent image and at least a tangential magnetic field at the exit of the development zone of a magnitude to optimize the adherence of carrier granules thereto so as to prevent carrier granules from adhering to the flexible member with the magnitude of the tangential magnetic field at the exit of the development zone being greater than the magnitude of the radial magnetic field in the center of the development zone; and means for maintaining the flexible member at a preselected tension of sufficient magnitude so that the developer material being transported into contact therewith deflects the flexible member about said magnetic means to form an extended development zone.

2. An apparatus according to claim 1, wherein the flexible member is a belt.

3. An apparatus according to claim 2, wherein said magnetic means includes:

a tubular member journaled for rotary movement; and a magnetic member disposed interiorly of and spaced from said tubular member.

4. An apparatus according to claim 3, wherein said magnetic member generates at least a radial magnetic field in the center of the development zone having a magnitude ranging from about 0 gauss to about 400 gauss.

5. An apparatus according to claim 4, wherein said magnetic member generates at least a tangential magnetic field at the exit of the development zone having a magnitude ranging from about 300 to about 550 gauss.

6. An electrophotographic printing machine of the type having an electrostatic latent image recorded on a flexible photoconductive member, wherein the improvement includes:

magnetic means, positioned closely adjacent the flexible photoconductive member to define a development zone therebetween, for transporting a developer material comprising at least magnetic carrier granules having toner particles adhering thereto into contact with the flexible photoconductive member in the development zone, said magnetic member generating at least a radial magnetic field in the development zone of a magnitude to optimize the attraction of the toner particles from the carrier granules to the latent image and at least a tangential magnetic field at the exit of the development zone of a magnitude to optimize the adherence of carrier granules thereto so as to prevent carrier granules from adhering to the flexible photoconductive member with the magnitude of the tangential magnetic field at the exit of the development zone being greater than the magnitude of the radial magnetic field in the center of the development zone; and means for maintaining the flexible photoconductive member at a preselected tension of sufficient magnitude so that the developer material being transported into contact therewith deflects the flexible photoconductive member about said magnetic means to form an extended development zone.

7. A printing machine according to claim 6, wherein the flexible photoconductive member is a belt.

8. A printing machine according to claim 7, wherein said magnetic means includes:

a tubular member journaled for rotary movement; and a magnetic member disposed interiorly of and spaced from said tubular member.

9. A printing machine according to claim 8, wherein said magnetic member generates at least a radial magnetic field in the center of the development zone having a magnitude ranging from about 0 gauss to about 400 gauss.

10. A printing machine according to claim 9, wherein said magnetic member generates at least a tangential magnetic field at the exit of the development zone having a magnitude ranging from about 300 to about 550 gauss.

* * * * *